US009570257B2

(12) United States Patent
Lundén et al.

(10) Patent No.: US 9,570,257 B2
(45) Date of Patent: Feb. 14, 2017

(54) METHOD FOR CONTROLLING A CONTACTOR DEVICE, AND CONTROL UNIT

(71) Applicant: ABB Schweiz AG, Baden (CH)

(72) Inventors: Björn Lundén, Järfälla (SE); Gunnar Johansson, Västerås (SE); Peter Fransson, Västerås (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/033,546

(22) PCT Filed: Nov. 12, 2013

(86) PCT No.: PCT/EP2013/073603
§ 371 (c)(1),
(2) Date: Apr. 29, 2016

(87) PCT Pub. No.: WO2015/070893
PCT Pub. Date: May 21, 2015

(65) Prior Publication Data

US 2016/0276122 A1 Sep. 22, 2016

(51) Int. Cl.
*H01H 47/00* (2006.01)
*H01H 47/32* (2006.01)
(Continued)

(52) U.S. Cl.
CPC ..... *H01H 47/325* (2013.01); *H01H 47/22* (2013.01); *H01H 50/18* (2013.01); *H01H 50/36* (2013.01);
(Continued)

(58) Field of Classification Search
CPC ..... H01H 47/325
(Continued)

(56) References Cited

U.S. PATENT DOCUMENTS 4,481,555 A * 11/1984 Yoshida ..... H01H 50/541 361/155
4,720,763 A * 1/1988 Bauer ..... H01H 47/325 335/231
(Continued)

FOREIGN PATENT DOCUMENTS

CN 101866777 A 10/2010
CN 201877347 U 6/2011
(Continued)

OTHER PUBLICATIONS

International Search Report Application No. PCT/EP2013/073603 Completed: Jul. 11, 2014;Mailing Date: Jul. 28, 2014 4 pages.
(Continued)

*Primary Examiner* — Stephen W Jackson
(74) *Attorney, Agent, or Firm* — Whitmyer IP Group LLC

(57) ABSTRACT

A method performed in a control unit for opening a contactor device. The contactor device includes a carrier being movable between a closed position in which a current is allowed to flow in a current path and an open position in which the current path is broken. The control unit is configured to enable the movement of the carrier between the closed position and the open position by energizing a coil of an electromagnetic circuit. The method includes: initiating the opening of the contactor device by de-energizing the coil, wherein the de-energizing includes using a demagnetization circuit including a discharge element, the discharge element being arranged to consume energy in the coil; bypassing, at a first point of time, the discharge element; and re-energizing the coil.

14 Claims, 5 Drawing Sheets

(51) Int. Cl.

| | |
|---|---|
| ***H01H 47/22*** | (2006.01) |
| ***H01H 50/18*** | (2006.01) |
| ***H01H 50/36*** | (2006.01) |
| ***H01H 50/56*** | (2006.01) |

(52) U.S. Cl.
CPC ..... *H01H 50/56* (2013.01); *H01H 2235/01* (2013.01)

(58) Field of Classification Search
USPC ..... 361/206
See application file for complete search history.

(56) References Cited

U.S. PATENT DOCUMENTS

| | | | | |
|---|---|---|---|---|
| 5,055,961 | A * | 10/1991 | Wiblin | H02H 9/047 323/270 |
| 7,483,254 | B1 | 1/2009 | Wang | |
| 7,933,109 | B2 * | 4/2011 | Mitlmeier | H01H 47/22 361/143 |
| 2001/0043450 | A1 | 11/2001 | Seale et al. | |

FOREIGN PATENT DOCUMENTS

| | | | |
|---|---|---|---|
| EP | 2551881 | A1 | 1/2013 |
| JP | 2004103318 | A | 4/2004 |

OTHER PUBLICATIONS

Written Opinion of the International Searching Authority Application No. PCT/EP2013/073603 Mailing Date: Jul. 28, 2014 6 pages.

* cited by examiner

METHOD FOR CONTROLLING A CONTACTOR DEVICE, AND CONTROL UNIT

TECHNICAL FIELD

The technology disclosed herein relates generally to the field of contactors used in electrical networks, and in particular to contactors the operation of which is controlled by electronics.

BACKGROUND

Within electrical networks contactors are often used for switching large electric currents. These contactors are designed for switching load currents that occur during normal conditions in various applications. The contactor is designed so as to be able to make, conduct and break the electric current.

Electromagnetically operated contactors typically comprise a spring-biased armature moving between two end positions. The armature is a part of an electromagnetic circuit. At a first end position the armature is open and the current path is then open, and at a second end position, the armature is closed and the contactor is then closed, thereby providing an electrical path. Normally contactors are monostable devices and the position of rest is the open position but the opposite positions are sometimes used. The armature is arranged to move a moving contact element relative fixed contact elements, thus breaking the electrical path when moving the moving contact element away from the fixed contact elements and making contact by the reverse movement. The movement of the armature is accomplished by energizing a coil of the electromagnetic circuit, the coil typically being wound around parts of either the armature or around a fixed part of the electromagnetic circuit.

Operation of such contactor entails applying a voltage over the coil, giving a current through it, whereby a magnetic flux is produced in the electromagnet. The magnetic flux attracts the armature, which forces contacts of the contactor to close. In the closed state, separation springs and contact springs of the contactor device are all biased and contain high potential energy. When an opening of the contactor is required, the electromagnetic circuit is de-energized whereby the opening is initiated. When the electromagnet is released, the potential energy in the springs is converted to kinetic energy and the armature holding a moving contact element moves rapidly towards its open position. In order to avoid bouncing effects and/or high mechanical impact in the contactor caused by this movement, this kinetic energy needs to be taken care of.

The use of rubber dampers is a known way of reducing the kinetic energy by absorbing the energy. However, although the rubber dampers may absorb up to 50% of the energy, these are not sufficient since the remaining energy causes so-called back travel, wherein the contactor elements of the contactor are moving towards a closed state again. This increases the risk of re-closing the contactor.

Another feasible solution would be to use hydraulic dampers or other advanced dampers, but such solutions are costly and are typically only viable in particular high-end applications.

Still another solution is to use the electromagnet of the contactor as a brake during the opening process. EP 2 551 881 is one example of using the electromagnet for reducing the velocity of the moving armature. The polarity of a power supply for the coil of the contactor is reversed whereby a deceleration is accomplished.

SUMMARY

An object of the present disclosure is to solve or at least alleviate one or more of the above mentioned problems.

The object is according to a first aspect achieved by a method performed in a control unit for opening a contactor device. The contactor device comprises a carrier being movable between a closed position in which a current is allowed to flow in a current path and an open position in which the current path is broken. The control unit is configured to enable the movement of the carrier between the closed position and the open position by energizing a coil of an electromagnetic circuit. The method comprises: initiating the opening of the contactor device by de-energizing the coil, wherein the de-energizing comprises using a demagnetization circuit 40 comprising a discharge element, the discharge element being arranged to consume energy in the coil; bypassing, at a first point of time, the discharge element; and re-energizing the coil.

The method enables braking of the contactor device during opening thereof by making use of the electromagnet of the contactor. Cost-efficient solutions for handling bouncing effects upon opening may be provided, the braking may for example be implemented by using electronic components and software.

The object is according to a second aspect achieved by a control unit for opening a contactor device, the contactor device comprising a carrier being movable between a closed position in which a current is allowed to flow in a current path and an open position in which the current path is broken. The control unit is configured to enable the movement of the carrier between the closed position and the open position by energizing a coil of an electromagnetic circuit. The control unit is configured to:

initiate the opening of the contactor device by de-energizing the coil, wherein the de-energizing comprises using a demagnetization circuit comprising a discharge element, the discharge element being arranged to consume energy in the coil, bypass, at a first point of time, the discharge element, and re-energize the coil.

Further features and advantages of the present disclosure will become clear upon reading the following description and the accompanying drawings.

DETAILED DESCRIPTION

Figure 1:
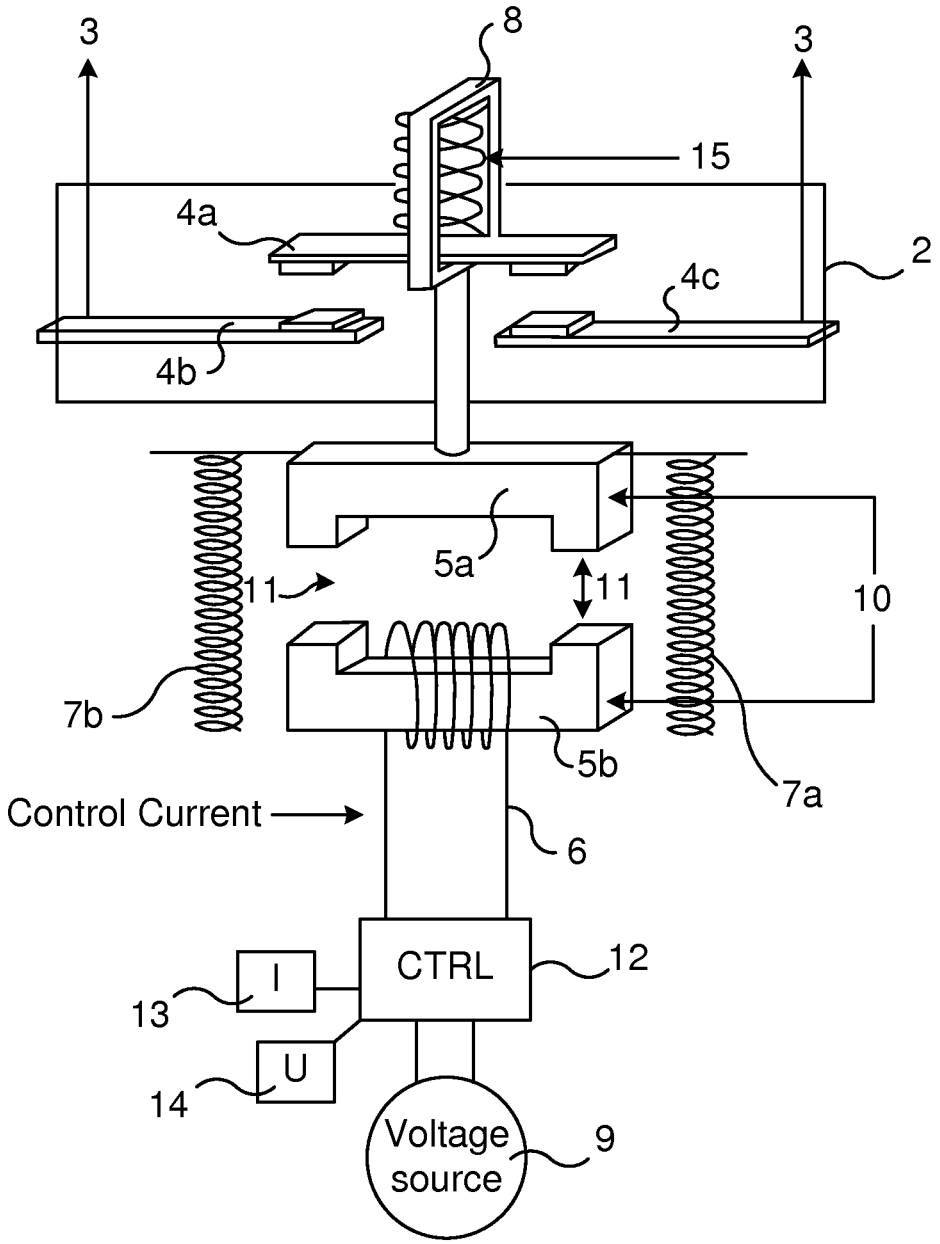
FIG. 1 illustrates an electromagnetically operated contactor device.

In the following description, for purposes of explanation and not limitation, specific details are set forth such as particular architectures, interfaces, techniques, etc. in order to provide a thorough understanding. In other instances, detailed descriptions of well-known devices, circuits, components and methods are omitted so as not to obscure the description with unnecessary detail. Same reference numerals refer to same or similar elements throughout the description.

FIG. 1 illustrates an electromagnetically operated contactor device 1, for which aspects of the present disclosure may be applied. The contactor device 1 comprises a contact part 2 arranged to make or break an electric path 3, e.g. to control the electric path in an electrical circuit. The contact part 2 comprises a moving contact element 4*a*, and first and second fixed contact elements 4*b*, 4*c* denoted fixed contact elements 4*b*, 4*c* in the following. When the fixed contact elements 4*b*, 4*c* are in mechanical contact with the moving contact element 4*a*, there is a closed electrical path 3, else the electrical path is broken (open).

The contactor device 1 further comprises an electromagnet 10. The electromagnet 10 comprises a moving magnet part 5*a*, a fixed magnet part 5*b* and a coil 6. In the following, the combination of the moving magnet part 5*a* and the fixed magnet part 5*b* is also denoted magnets 5*a*, 5*b*. The magnets 5*a*, 5*b* are movable in relation to each other and the fixed magnet part 5*b* may for example be bolted to a wall or the like. The magnets 5*a*, 5*b*, which may be U-shaped, are for example, and as is well recognized within the art, arranged so that the two leg parts of the moving U-shaped magnet part 5*a* have essentially the same axial extension as the corresponding two leg parts of the fixed U-shaped magnet part 5*b*. The leg parts of the U-shaped magnets 5*a*, 5*b* thus have opposing end surfaces, between which an air gap 11 is created. It is noted that the electromagnet 10 may alternatively be designed in any other conventional manner.

The coil 6 may be wound around one or more parts of the magnet 5*a*, 5*b*. The coil 6 is connected to a voltage source 9 and when energizing the coil 6 a magnetic field is produced in the magnets 5*a*, 5*b*.

The electromagnet 10 is mechanically connected to a contact carrier 8, in the following denoted carrier 8. In particular, the moving magnet part 5*a* of the electromagnet 10 is mechanically connected to the carrier 8. The carrier 8 is mechanically connected also to the moving contact element 4*a*. A spring element, denoted contact spring 15, may be arranged in the carrier 8, in order to bias the moving contact element 4*a*, for example by being arranged between the carrier 8 and the moving contact element 4*a*.

For opening the contactor device 1, the carrier 8 is arranged to separate the moving contact element 4*a* of the contact part 2 from the fixed contact elements 4*b*, 4*c* of the contact part 2, thus breaking the electrical path 3. The carrier 8 is also arranged to close contact between the moving contact element 4*a* and the fixed contact elements 4*b*, 4*c*, thus closing the electrical path 3 and allowing electric current to flow. The carrier 8 is arranged to accomplish this by being movable between two end positions. The movement in turn is accomplished by controlling the electromagnet 10.

When the coil 6 is not energized, i.e. when there is no current flowing through the coil 6, spring elements 7*a*, 7*b*, in the following denoted separation springs 7*a*, 7*b*, are arranged to press the moving magnet part 5*a* apart from the fixed magnet part 5*b* thus increasing the air gap 11, and putting the contactor device 1 in its fully open position, i.e. the moving contact element 4*a* is not interconnecting the fixed contact elements 4*b*, 4*c*. In an aspect of the present disclosure, the kinetic energy of these separation springs 7*a*, 7*b* (also known as return springs) as well as the kinetic energy of the contact spring 15 is taken care of by making use of the electromagnet 10.

When an electric voltage is applied to the coil 6, electric current flows through the coil 6 and the magnets 5*a*, 5*b* become magnetized. The magnetic field thereby generated attracts the magnets 5*a*, 5*b* to each other. When sufficient current is flowing in the coil 6 the carrier 8 starts moving (in the downwards direction in the set-up of FIG. 1). When disconnecting the voltage supply to the coil 6, the opening of the contactor begins.

A control unit 12 is provided for controlling the contactor device 1, and in particular the opening, holding and closing thereof. The control unit 12 comprises means, e.g. circuitry, electronic circuits, processing circuitry, memory, voltage sources and devices etc., for energizing the coil 6 and controlling the movement of the carrier 8 as well as controlling other operations of the contactor device 1. Circuitries, or sensor devices, illustrated at reference numerals 13 and 14, may be provided for determining coil current and coil voltage. Such sensor devices 13, 14 may be part of the control unit 12, or may be separately arranged devices which provide the control unit 12 with measurement values.

Briefly, in an aspect of the present disclosure, the electromagnetic damping is provided by re-energizing the coil 6 in a controlled manner after initiation of the opening. A brief pull-in force is thereby created that counteracts the movement of the carrier 8 away from the closed position. The re-energizing is implemented so as to create a force strong enough to slow down the back-travelling after release, while being weak enough to prohibit a full reverse movement (i.e. closing movement) reconnecting the contactor device 1.

The electromagnet 10 is thus activated during the opening of the contactor device 10 in order to create a braking force and thereby reduce the velocity of the carrier 8 and thus the moving contact element 4*a*. In various embodiments, the braking force is accomplished by activating the electromagnet 10 during the opening phase. In an aspect of the present disclosure, a suitable timing for activating the electromagnet 10 in the opening phase is determined.

Figure 2:
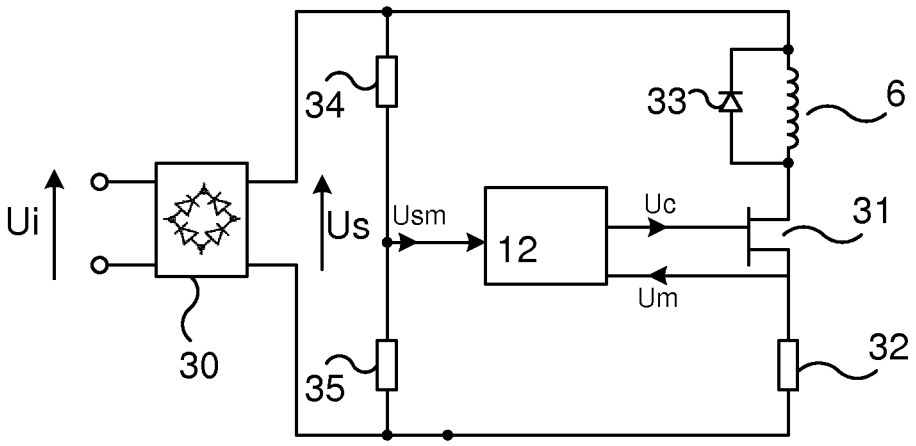
FIG. 2 illustrates a circuit diagram of the contactor device of FIG. 1.

FIG. 2 illustrates an exemplary circuit diagram representing an implementation of the contactor device 1 of FIG. 1. A voltage $U_i$ is supplied by the voltage source 9 (refer to FIG. 1). Closing of the contactor device 1 is performed by connecting the voltage source 9, while opening is performed by disconnecting the voltage source 9. The supply voltage may be supplied via a full-wave rectifier 30, the output voltage $U_s$ of which is a direct voltage if the supplied voltage is a direct voltage and a full-wave rectified alternating voltage if the supplied voltage is an alternating voltage. The output voltage $U_s$ is supplied to the coil 6 of the contactor device 1. The coil 6 is series-connected to a first electronic switch (e.g. transistor) 31 and a small series resistor 32, also denoted measuring resistor 32, arranged for current measurements. The coil 6 is connected in anti-parallel with a free-wheeling diode 33.

The control unit 12 is adapted to, with the aid of the first switch 31, control the voltage over the coil 6 by pulse-width modulation. The control unit 12 outputs a control signal $U_c$ to the gate of the first switch 31 and controls the first switch 31 with pulse width modulation, for instance using a constant pulse frequency and with a variable pulse width. The control unit 12 is supplied with a voltage $U_m$ occurring across the measuring resistor 32, which voltage is a measure of the current through the coil 6. A voltage divider formed by resistors 34, 35 arranged in parallel with the control unit 12 delivers a measured signal $U_{sm}$ to the control unit 12, which measured signal $U_{sm}$ is proportional to the voltage $U_i$.

Figure 3:
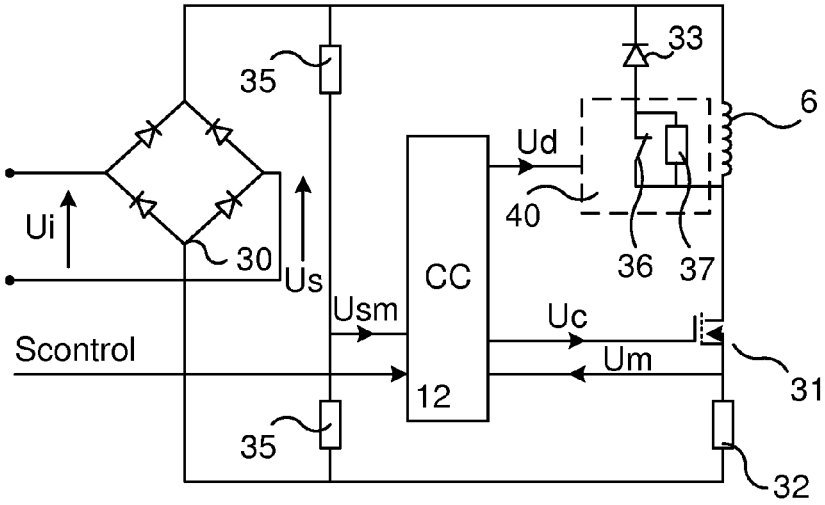
FIG. 3 illustrates embodiments of the present disclosure.

FIG. 3 illustrates a circuit diagram of the contactor device 1 for which embodiments of the present disclosure may be implemented. The same reference numerals as used in FIG. 2 are used also in FIG. 3 for indicating same or corresponding parts and the same description as given above with reference to FIG. 2 applies also for FIG. 3.

In addition to the components corresponding to the ones illustrated in FIG. 2, the circuit of FIG. 3 comprises a demagnetization circuit 40. The demagnetization circuit 40 comprises a second electronic switch 36 (e.g. a transistor) and a discharge element 37 connected in parallel with the second switch 36. Examples of such discharge elements comprise resistor, zener diode, varistor etc. The demagnetization circuit 40 is arranged to consume the energy in the coil 6 and thereby de-energize the coil 6. The control unit 12 is adapted to control the second switch 36 by a control signal, e.g. by controlling the voltage to the gate of the first switch, so as to switch it on or off in conventional manner. The control signal is represented in the figure by voltage $U_d$. It is noted that the control unit 12 may be adapted to control the second switch 36 in various alternative ways, for example by controlling the second switch 36 via the first switch 31.

During the closed state of the contactor device 1, when voltage source 9 is providing power, current flows through the coil 6 and the freewheeling diode 33 and the coil inductance is high. When de-energizing the coil 6, i.e. when disconnecting the voltage source 9 and thus removing voltage $U_i$, the second switch 36 and the first switch 31 are opened and the coil current flows through the discharge element 37, which thus consumes the energy. Without the demagnetization circuit 40 consuming the energy, the coil current would circulate for a rather long time before reaching a value sufficiently low for the opening process to begin. Such opening process would take too long for the contactor device 1 to be usable, hence the use of the demagnetization circuit 40.

It is noted that the voltage $U_i$ (and thus $U_s$ which is the rectified voltage) provided by voltage source 9 may be disconnected in various ways. In particular, the voltage source 9 may be connected at such to the circuit at all times, and the control unit 12 may receive a control signal $S_{control}$, e.g. having values ON/OFF, based on which the control unit 12 provides or does not provide the voltage $U_s$ to the components of the circuitry. In the following, when the voltage $U_s$ is not provided to a circuit, the voltage source 9 is said to be disconnected. However, this should be interpreted in a broad sense, including use of the control signal $S_{control}$ as described.

In a first embodiment of the present disclosure, the demagnetization circuit 40 and in particular the second switch 36 thereof is used for accomplishing a braking force to counteract the kinetic energy of the carrier 8. Opening of the contactor device 1 is thus initiated by disconnecting the voltage source 9 and the second switch 36 is opened. At a specific time (to be described more in detail with reference to FIGS. 5 and 6), the second switch 36 is again closed, thus bypassing the discharge element 37 and current flow through the freewheeling diode 33. A current is induced in the coil owing to the movement of the carrier 8, which current will create a braking force of the electromagnet 10. This braking force realized by self induction makes use of already existing components and methods for controlling this braking force may be implemented by software solutions, e.g. implemented using software instructions such as computer program executing in a processor and/or using hardware, such as application specific integrated circuits, field programmable gate arrays, discrete logical components etc. However, the braking force created by the self inductance may not be sufficiently high for all contactor device applications, but is very well suited for many contactor devices.

In a second embodiment of the present disclosure, and with reference still to FIG. 3, the first switch 31 and the second switch 36 are used for accomplishing the desired braking force. As for the first embodiment, the opening of the contactor device 1 is initiated by disconnecting the voltage source 9 and the second switch 36 is opened. As mentioned earlier, this may be accomplished by a control signal $S_{control}$. At a specific time, the second switch 36 is again closed, thus bypassing the discharge element 37 and current flow through the freewheeling diode 33. At this specific time, or some time later, the first switch 31 is also closed. The voltage $U_i$ is thereby reconnected thus increasing current through the coil 6 and creating the braking force. The current through the coil 6 should be controlled so as to avoid any risks of creating a current high enough to reverse the movement of the carrier 8. The first switch 31 is therefore controlled as described earlier in relation to FIG. 2. In particular, the control unit 12 is adapted to, with the aid of the first switch 31, control the voltage over the coil 6 by pulse-width modulation. The control unit 12 outputs a control signal $U_c$ to the first switch 31 and controls it with a variable pulse width using conventional pulse width modulation. This embodiment may also be implemented by using existing components and implementing the control by software solutions. Further, the braking force that may be created is high and this embodiment may be used for still additional contactor devices compared to the first embodiment.

Figure 4:
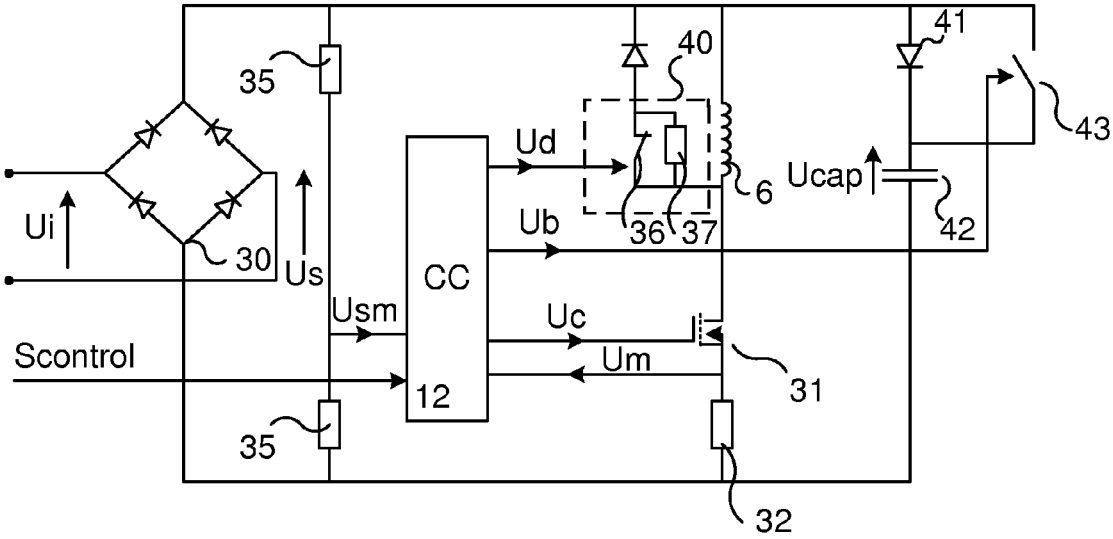
FIG. 4 illustrates another embodiment of the present disclosure.

FIG. 4 illustrates a third embodiment of the present disclosure, and in particular a schematic of a control circuit. In this embodiment, a capacitor 42 is connected to the voltage source 9. A diode 41 is connected in series with the capacitor 42. Further, a third electronic switch 43 is introduced. The third switch 43, and in particular the opening and closing thereof, is controlled by a control signal $U_b$ provided by the control unit 12. The third switch 43 is connected in parallel with the diode 41.

The capacitor 42 may be charged during the closing state and/or holding state of the contactor device 1. For contactor devices 1 being configured for yet additional states, e.g. idle state, the capacitor 42 may be charged during such states as well. The charging may be done directly through diode 41 as in FIG. 4 or by additional circuitry (not illustrated) providing suitable voltage and current to the capacitor 42.

The opening of the contactor device 1 is initiated by disconnecting the voltage source 9. The first switch 31 and the second switch 36 are controlled so as to be opened. The current now flows through the discharge element 37 and the coil current is reduced. When the contactor device 1 starts opening, i.e. when the moving magnet 5*a* starts to separate from the fixed magnet 5*b*, the first switch 31 and the third switch 43 are closed (by control signals $U_c$ and $U_b$, respectively). The capacitor is now discharged through the coil 6, thus increasing the coil current and creating the braking force.

The capacitor 42 may be dimensioned for obtaining a desired value of the current through the coil 6, e.g. the voltage rating thereof is chosen suitably. In variations of this embodiment, the capacitor 42 may be charged to a specific voltage $U_{cap}$, by using additional circuitry (not illustrated), for providing a desired coil current and thus the required braking force for a particular application. An example of such additional circuitry comprises a charge pump.

The capacitor 42 provides electrical power (voltage $U_{cap}$) for creating the braking force even in case the voltage supply 9 is not available for the purpose of braking the carrier 8 electromagnetically. This is very advantageous since the voltage supply 9 is often configured to be connected during closing and closed state and disconnected during opening and open state.

Figure 5:
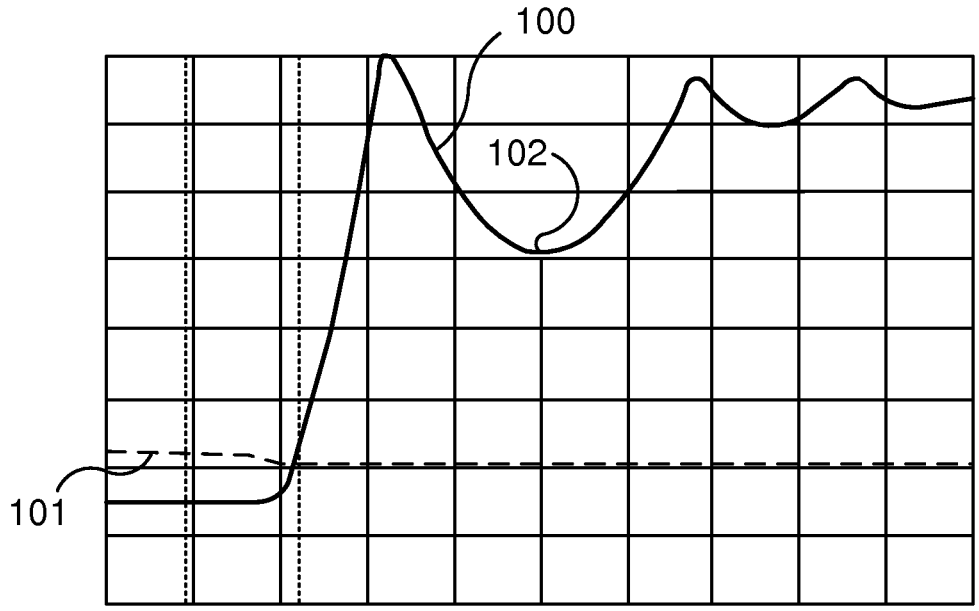
Fig. 5 (Prior Art)
FIG. 5 illustrates graphs over coil current and carrier movement during an opening procedure according to prior art.

FIG. 5 illustrates graphs over coil current and carrier movement during an opening procedure according to prior art. Graph indicated by reference numeral 100 shows the carrier 8 position as function of time and the graph indicated by reference numeral 101 shows the current through the coil 6 during the opening. The derivative of the carrier 8 position, i.e. the derivative of graph 100, gives the velocity of the carrier 8. As is evident from the FIG. 5, this velocity is quite high, resulting in opening bounces. An opening bounce is illustrated at arrow 102.

Figure 6:
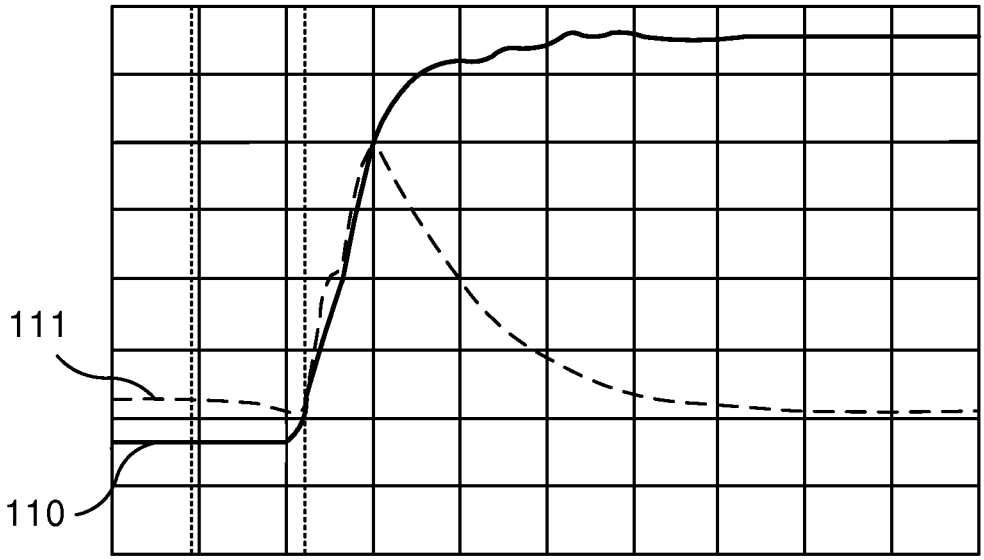
FIG. 6 illustrates graphs over coil current and carrier movement during an opening procedure when implementing aspects of the present disclosure.

FIG. 6 illustrates graphs over coil current and carrier movement during an opening procedure when implementing aspects of the present disclosure. Graph indicated by reference numeral 110 shows the carrier 8 position as function of time and the graph indicated by reference numeral 111 shows the current through the coil 6 during the opening. As is evident from the FIG. 5, the derivative of graph 110 is less than the derivative of the corresponding graph 100 of FIG. 5. That is, the velocity of the carrier 8 is reduced compared to the prior art solution. FIG. 6 thus shows that the opening bounces can be reduced and even eliminated by using the present disclosure.

In accordance with the present disclosure, and as has been described in various embodiments, a voltage is applied to the coil 6 after initiation of the opening process for providing a current through the coil 6. This voltage should be applied at a suitable point of time. For example, the time at which to apply the voltage may be determined based on simulations and/or experience, so that the time elapsed from the initiation of the opening, i.e. from the de-energizing of the coil 6, to the point of time for re-energizing the coil 6, results in a sufficiently long braking period before the carrier 8 reaches its fully open position.

Figure 7:
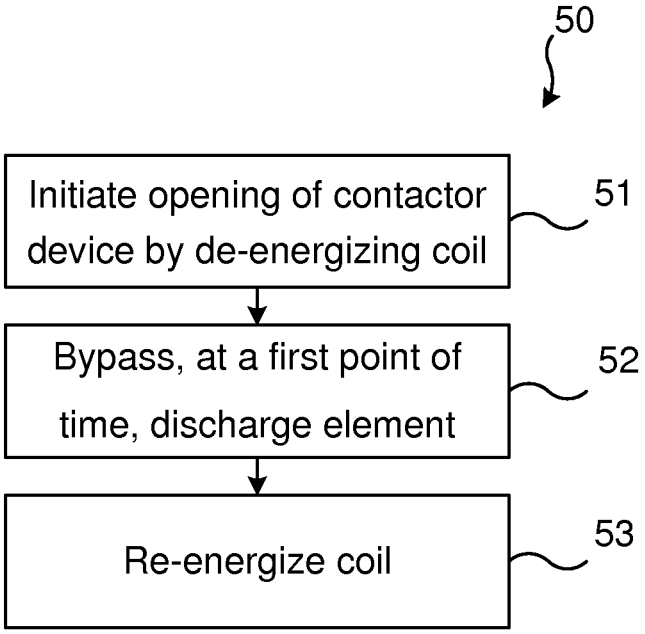
FIG. 7 illustrates a flow chart over steps of a method for controlling a contactor device in accordance with the present disclosure.

FIG. 7 illustrates a flow chart over steps of a method 50 for controlling a contactor device 1 in accordance with the present disclosure. The method 50 may be performed in a control unit 12 for opening a contactor device 1. The contactor device 1 comprises a carrier 8 that is movable between a closed position in which a current is allowed to flow in a current path and an open position in which the current path is broken. The control unit 12 is configured to enable the movement of the carrier 8 between the closed position and the open position by energizing a coil 6 of an electromagnetic circuit. The method 50 comprises initiating 51 the opening of the contactor device 1 by de-energizing the coil 6, wherein the de-energizing comprises using a demagnetization circuit 40 comprising a discharge element 37, the discharge element 37 being arranged to consume energy in the coil 6, The method 50 comprises bypassing 52, at a first point of time, the discharge element 37.

The method 50 comprises re-energizing 53 the coil 6.

In a most basic implementation, the coil 6 is re-energized 53 simply by bypassing the discharge element 37, the re-energization being provided by current induced in the coil 6 by movement of the carrier 8, i.e. by self-induction. This self-induced current then provides the braking force, as has been described earlier.

In an embodiment, the re-energizing 53 comprises applying a voltage $U_s$, $U_{cap}$ over the coil 6. Such embodiments may provide a larger braking force compared to the basic embodiment.

In a variation of the above embodiment, the method 50 comprises controlling the voltage $U_s$, $U_{cap}$ of the voltage source 9, 42 so as to provide a current through the coil 6 having a value below a current required to move a carrier 8 of the electromagnetic circuit towards its closed position. The control unit 12 may be configured to ensure that any back travel is avoided, eliminating any risk of the contactor device 1 closing again due to the braking force.

In an embodiment, the re-energizing 53 comprises connecting a capacitor 42 in parallel with the coil 6. The re-energizing 53 may then comprise discharging the capacitor 42 through the coil 6.

In variations of the above embodiments, the method 50 comprises charging the capacitor 42 to a configurable voltage, the configurable voltage providing a desired coil current.

In an embodiment, the initiating 51 of the opening of the contactor device 1 by de-energizing the coil 6 comprises disconnecting a voltage source 9 arranged to provide a current through the coil 6 for holding the carrier 8 in the closed position.

Figure 8:
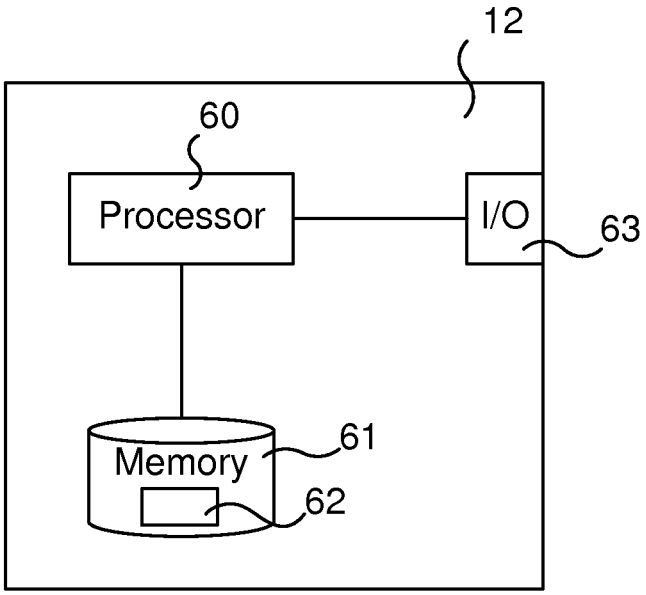
FIG. 8 illustrates a control unit adapted to control a contactor device in accordance with the present disclosure.

FIG. 8 illustrates a control unit 12 adapted to control a contactor device 1 in accordance with the present disclosure. The control unit 12 may comprise a processor 60 comprising any combination of one or more of a central processing unit (CPU), multiprocessor, microcontroller, digital signal processor (DSP), application specific integrated circuit etc. capable of executing software instructions stored in a memory 61, which can thus be a computer program product 61. The processor 60 can be configured to execute any of the various embodiments of the method as described in relation to FIG. 7.

Still with reference to FIG. 8, the memory 61 can be any combination of read and write memory (RAM) and read only memory (ROM). The memory 61 may also comprise persistent storage, which, for example, can be any single one or combination of magnetic memory, optical memory, solid state memory or even remotely mounted memory.

The control unit 12 may further comprise an input/output (I/O) device 63 for receiving data from external devices. For example, the I/O device 63 may be used for receiving control signals, such as control signal $S_{control}$.

The control unit 12 is adapted for opening a contactor device 1 as described, in particular comprising a carrier 8 that is movable between a closed position in which a current is allowed to flow in a current path and an open position in which the current path is broken. The control unit 12 is configured to enable the movement of the carrier 8 between the closed position and the open position by energizing a coil 6 of an electromagnetic circuit. The control unit 12 is configured to:

- initiate the opening of the contactor device 1 by de-energizing the coil 6, wherein the de-energizing comprises using a demagnetization circuit 40 comprising a discharge element 37, the discharge element 37 being arranged to consume energy in the coil 6;

bypass, at a first point of time, the discharge element 37; and re-energize the coil 6.

In an embodiment, the control unit 12 is configured to re-energize by applying a voltage $U_s$, $U_{cap}$ over the coil 6. The control unit 12 may for example be configured to control any one or any combination of the switches 31, 36, 43 for accomplishing this.

In an embodiment, the control unit 12 is configured to control the voltage $U_s$, $U_{cap}$ of the voltage source 9, 42 so as to provide a current through the coil 6 having a value below a current required to move a carrier 8 of the electromagnetic circuit towards its closed position.

In an embodiment, the control unit 12 is configured to re-energize by connecting a capacitor 42 in parallel with the coil 6.

In an embodiment, the control unit 12 is configured to re-energize by discharging the capacitor 42 through the coil 6.

In an embodiment, the control unit 12 is configured to charge the capacitor 42 to a configurable voltage, the configurable voltage providing a desired coil current.

In an embodiment, the control unit 12 is configured to initiate the opening of the contactor device 1 by de-energizing the coil 6 by disconnecting a voltage source 9 arranged to provide a current through the coil 6 for holding the carrier 8 in the closed position.

The teachings of the present application also encompasses a computer program product 61 comprising a computer program 62 for implementing the methods as described above, and a computer readable means on which the computer program 62 is stored. The computer program product 61 may be any combination of read and write memory (RAM) or read only memory (ROM). The computer program product 61 may also comprise persistent storage, which for example can be any single one or combination of magnetic memory, optical memory or solid state memory.

The present teachings thus comprise a computer program 62 for a control unit 12 as described. The computer program 62 comprising computer program code, which, when run on the control unit 12, and in particular a processor thereof 60, causes the control unit 12 to:

initiate the opening of the contactor device 1 by de-energizing the coil 6, wherein the de-energizing comprises using a demagnetization circuit 40 comprising a discharge element 37, the discharge element 37 being arranged to consume energy in the coil 6, bypass, at a first point of time, the discharge element 37, and re-energize the coil 6.

The invention claimed is:

1. A method performed in a control unit for opening a contactor device, the contactor device comprising a carrier being movable between a closed position in which a current is allowed to flow in a current path and an open position in which the current path is broken, the control unit being configured to enable the movement of the carrier between the closed position and the open position by energizing a coil of an electromagnetic circuit, the method comprising:

initiating the opening of the contactor device by de-energizing the coil, wherein the de-energizing comprises using a demagnetization circuit comprising a discharge element, the discharge element being arranged to consume energy in the coil, bypassing, at a first point of time, the discharge element, and re-energizing the coil.

2. The method as claimed in claim 1, wherein the re-energizing comprises applying a voltage $U_s$, $U_{cap}$ over the coil.

3. The method as claimed in claim 2, comprising controlling the voltage $U_s$, $U_{cap}$ of the voltage source so as to provide a current through the coil having a value below a current required to move a carrier of the electromagnetic circuit towards its closed position.

4. The method as claimed in claim 1, wherein the re-energizing comprises connecting a capacitor in parallel with the coil.

5. The method as claimed in claim 4, wherein the re-energizing comprises discharging the capacitor through the coil.

6. The method as claimed in claim 4, comprising charging the capacitor to a configurable voltage, the configurable voltage providing a desired coil current.

7. The method as claimed in claim 1, wherein the initiating of the opening of the contactor device by de-energizing the coil comprises disconnecting a voltage source arranged to provide a current through the coil for holding the carrier in the closed position.

8. A control unit for opening a contactor device, the contactor device comprising a carrier being movable between a closed position in which a current is allowed to flow in a current path and an open position in which the current path is broken, the control unit being configured to enable the movement of the carrier between the closed position and the open position by energizing a coil of an electromagnetic circuit, the control unit being configured to:

initiate the opening of the contactor device by de-energizing the coil, wherein the de-energizing comprises using a demagnetization circuit comprising a discharge element, the discharge element being arranged to consume energy in the coil, bypass, at a first point of time, the discharge element, and re-energize the coil.

9. The control unit as claimed in claim 8, configured to re-energize by applying a voltage $U_s$, $U_{cap}$ over the coil.

10. The control unit as claimed in claim 9, configured to control the voltage $U_s$, $U_{cap}$ of the voltage source so as to provide a current through the coil having a value below a current required to move a carrier of the electromagnetic circuit towards its closed position.

11. The control unit as claimed in claim 8, configured to re-energize by connecting a capacitor in parallel with the coil.

12. The control unit as claimed in claim 11, configured to re-energize by discharging the capacitor through the coil.

13. The control unit as claimed in claim 11, configured to charge the capacitor to a configurable voltage, the configurable voltage providing a desired coil current.

14. The control unit as claimed in claim 8, configured to initiate the opening of the contactor device by de-energizing the coil by disconnecting a voltage source arranged to provide a current through the coil for holding the carrier in the closed position.

* * * * *